US008471486B2

(12) United States Patent
Huang et al.

(10) Patent No.: US 8,471,486 B2
(45) Date of Patent: Jun. 25, 2013

(54) ENERGY-SAVING MECHANISMS IN MULTI-COLOR DISPLAY DEVICES

(75) Inventors: Ming-Hsin Huang, Baoshan Township (TW); Ke-Horng Chen, Banqiao (TW)

(73) Assignee: Taiwan Semiconductor Manufacturing Company, Ltd. (TW)

( * ) Notice: Subject to any disclaimer, the term of this patent is extended or adjusted under 35 U.S.C. 154(b) by 439 days.

(21) Appl. No.: 12/764,410

(22) Filed: Apr. 21, 2010

(65) Prior Publication Data

US 2011/0260643 A1 Oct. 27, 2011

(51) Int. Cl.
*H05B 37/02* (2006.01)

(52) U.S. Cl.
USPC ..... 315/209 R; 315/307; 315/308

(58) Field of Classification Search
USPC ..... 315/209 R, 307, 308
See application file for complete search history.

(56) References Cited

U.S. PATENT DOCUMENTS

| | | | | |
|---|---|---|---|---|
| 6,370,039 | B1 * | 4/2002 | Telefus | 363/15 |
| 7,408,308 | B2 | 8/2008 | Sawada et al. | |
| 7,432,614 | B2 * | 10/2008 | Ma et al. | 307/31 |
| 7,605,809 | B2 * | 10/2009 | Wey et al. | 345/212 |
| 7,888,920 | B2 * | 2/2011 | Chen et al. | 323/271 |
| 8,115,412 | B2 * | 2/2012 | Urakabe et al. | 315/294 |
| 2006/0192728 | A1 | 8/2006 | Kim | |
| 2010/0253302 | A1 * | 10/2010 | Otte et al. | 323/282 |

OTHER PUBLICATIONS

Hsieh, Chun-Yu et al., "Boost DC-DC Converter with Fast Reference Tracking (FRT) and Charge-Recycling (CR) Techniques for High-Efficiency and Low-Cost LED Driver", IEEE Journal of Solid-State Circuits, vol. 44, No. 9, Sep. 2009, pp. 2568-2580.

AS3694 12 Channel High Precision LED Driver for LCD Backlight and 3 DCDC Step Up Controller, Product Brief, Revision 1.1 / Nov. 25, 2007, www.austriamicrosystems.com (mpa), 1-3 to 3-3.

* cited by examiner

*Primary Examiner* — Thuy Vinh Tran
*Assistant Examiner* — Anthony Arpin
(74) *Attorney, Agent, or Firm* — Lowe Hauptman Ham & Berner, LLP

(57) ABSTRACT

Some embodiments regard a method comprising: using an input voltage to generate an output voltage having a first voltage level; in a first period, when the output voltage changes from the first voltage level to a second voltage level, storing electrical charges resulted from the output voltage changing from the first voltage level to the second voltage level; and in a second period subsequent to the first period when the output voltage demands energy, using a voltage generated from the stored electrical charges in place of the input voltage to generate the output voltage.

20 Claims, 11 Drawing Sheets

ENERGY-SAVING MECHANISMS IN MULTI-COLOR DISPLAY DEVICES

FIELD

The present disclosure is generally related to saving energy, and, in some embodiments, the energy saving is used in multi-color Light-Emitting Diode (LED) backlights or displays.

BACKGROUND

RGB (red, green, blue) LED backlights are commonly used to increase the gamut range of LED-backlit LCD televisions. Such RGB LEDs can also be used to directly display images in LED televisions (LED TVs). Each R, B, or G light or diode, however, requires a different turn-on voltage (e.g., the forward-bias voltage). As a result, when a same driving voltage is used to bias all R, G, and B LEDs in the same circuit, the R LEDs appear to consume much more power than the G and B LEDs. Various approaches use different techniques to reduce power consumption, but increase the size and cost for printed-circuit boards (PCBS) having the LEDs, due to additional components/circuitry. For example, one approach that uses three power converters, one for each R, G, and B LED also uses three inductors and numerous external components. Another approach uses a parallel driving structure, but with a complex transformer and two inductors. Another approach uses a single converter, but also uses a pulse-width modulator (PWM) current controller that consumes high power.

BRIEF DESCRIPTION OF THE DRAWINGS

The details of one or more embodiments of the disclosure are set forth in the accompanying drawings and the description below. Other features and advantages will be apparent from the description, drawings, and claims.

Like reference symbols in the various drawings indicate like elements.

DETAILED DESCRIPTION

Figure 1:
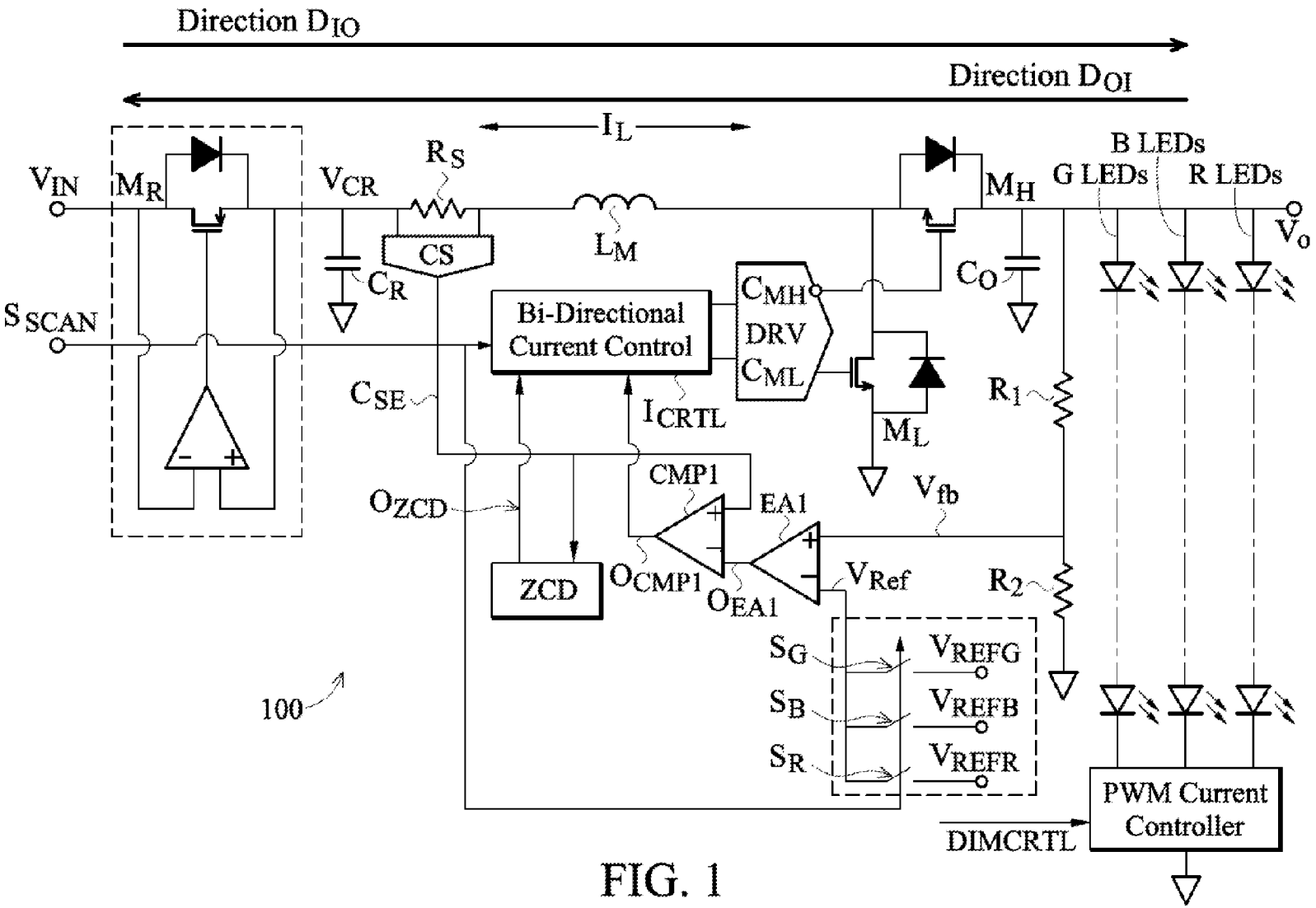
FIG. 1 is a schematic diagram of a circuit that uses some embodiments.

Embodiments, or examples, illustrated in the drawings are now being disclosed using specific language. It will nevertheless be understood that the embodiments and examples are not intended to be limiting. Any alterations and modifications in the disclosed embodiments, and any further applications of the principles disclosed in this document are contemplated as would normally occur to one of ordinary skill in the pertinent art. Reference numbers may be repeated throughout the embodiments, but they do not require that feature(s) of one embodiment apply to another embodiment, even if they share the same reference number.

Exemplary Circuit

FIG. 1 is a diagram of an exemplary circuit 100 that uses some embodiments. Circuit 100 can be called a power converter, a power driver, etc. In some embodiments, circuit 100 operates in a cycle including a first boost mode, an energy recycling mode, a silence mode, an energy transfer mode, and a second boost mode. Voltage $V_{IN}$ is a DC voltage around 12V. Additionally, when current $I_L$ switches in the positive domain, current $I_L$ flows in the direction from node $V_{IN}$ towards node $V_O$, e.g., direction $D_{IO}$, and in the direction from node $V_O$ towards node $V_{IN}$, e.g., direction $D_{OI}$ when current $I_L$ switches in the negative domain. For illustration, the symbol $|I_L|$ refers to the amplitude of current $I_L$.

Active diode $M_R$ controls the current flow between nodes $V_{IN}$ and $V_{CR}$. When voltage $V_{IN}$ is greater than voltage $V_{CR}$, diode $M_R$ turns on allowing current to flow from node $V_{IN}$ to node $V_{CR}$. But when voltage $V_{IN}$ is lesser than voltage $V_{CR}$ diode $M_R$ turns off and thus electrically disconnects node $V_{IN}$ from node $V_{CR}$. When diode $M_R$ is on, voltage $V_{CR}$ is lower than voltage $V_{IN}$, the voltage drop across diode $M_R$, which, in some embodiments, is about 0.2V. In some embodiments, diode $M_R$ is turned on/off automatically based on the relationship between voltages $V_{IN}$ and $V_{CR}$. For example, initially in the first boost mode during a display of one or more LEDs of a first color, e.g., the B LED (blue LED), when there is no current $I_L$, voltage $V_{CR}$ is 0V, $V_{IN}$ at about 12V is greater than $V_{CR}$ and thus turns on diode $M_R$. Current $I_L$ then flows. But when current $I_L$ increases causing $V_{CR}$ to increase until $V_{CR}$ is greater than $V_{IN}$ diode $M_R$ turns off. Active diode $M_R$ is used for illustration only, a conventional diode or equivalent circuitry can be used.

Capacitor or energy tank $C_R$ stores energy when output voltage $V_O$ drops (e.g., from 40V to 26V) and increases voltage $V_{CR}$ in the energy recycle mode. After the energy is recycled, it is later used, e.g., to drive the LEDs. For example, in the energy-transfer mode, voltage $V_{CR}$ representing the stored energy is used to drive one or more LEDs of a second color, e.g., the G LED (green LED). Without this saved energy that generates voltage $V_{CR}$, voltage $V_{IN}$ would be used. Because voltage $V_{CR}$ instead of voltage $V_{IN}$ is used, energy is saved.

Resistor $R_S$ is used to sense inductor current $I_L$. Circuit CS, based on current $I_L$ flowing through resistor $R_S$, generates signal (e.g., voltage) $C_{SE}$ based on which current direction controller $I_{CTRL}$ generates signals $C_{ML}$ and $C_{MH}$ to turn on/off powered NMOS transistors $M_L$ and $M_H$. In some embodiments, the magnitude of voltage $C_{SE}$ (e.g., $|C_{SE}|$) is proportional to the magnitude of current $I_L$. Further, when current $I_L$ is positive, voltage $C_{SE}$ is positive, but when current $I_L$ is negative, voltage $C_{SE}$ is negative. The magnitude of current $I_L$ (e.g., whether increasing or decreasing) depends on which of the two powered NMOS $M_L$ or $M_H$ is turned on. In effect, signal $O_{CMP1}$ generated by amplifier CMP1 having voltage $C_{SE}$ as an input limits the current $I_L$ when $|C_{SE}|$ is greater than signal $|O_{EA1}|$. Voltage $C_{SE}$ together with circuit ZCD is also used to detect the zero current condition of current $I_L$ (e.g., when $|I_L|$ has decreased to zero from a positive current or increases to zero from a negative current). When current $I_L$ is zero, voltage $C_{SE}$ is zero. Zero current detector ZCD recognizing signal $C_{SE}$ being 0 (i.e., $I_L$ being 0) generates signal $O_{ZCD}$ indicating a zero current condition based on which current controller $I_{CTRL}$ generates signals $C_{ML}$ and $C_{MH}$. For example, when $|I_L|$ decreases to 0, current direction controller $I_{CTRL}$ based on signal $O_{CMP1}$ generates a high signal $C_{ML}$ and a low signal $C_{MH}$ to turn on the respective powered NMOS $M_L$ and $M_H$. Turning on NMOS $M_L$ and turning off NMOS $M_H$ changes the flow of current $I_L$ (e.g., from decreasing to increasing).

Inductor $L_M$, powered NMOS $M_H$, and powered NMOS $M_L$ form a power converter providing voltage $V_O$ to drive the array of multi-color LEDs. In the particularly illustrated embodiments, blue/red/green LEDs (BRG LEDs) are used in the array. However, LEDs of one or more other colors are used in some embodiments. Likewise, any other types of light emitting devices including, but not limited to, laser diodes or OELDs (organic electro luminescent device), are used in further embodiments. In some embodiments, when NMOS $M_L$ is on NMOS $M_H$ is off, and when NMOS $M_L$ is off NMOS $M_H$ is on. When NMOS $M_L$ is on a current path is created and current $I_L$ flows through NMOS $M_L$ to ground. When NMOS $M_L$ is off and NMOS $M_H$ is on, the current $I_L$ flows through NMOS $M_H$ to the BRG LEDs. In some embodiments, powered NMOS $M_L$ and $M_H$ (as opposed to conventional NMOS transistors) are used to handle large current flowing through them.

Current controller $I_{CRTL}$ controls the direction of energy flow or the direction of current $I_L$. In some embodiments, when $I_L$ increases and is larger than zero current $I_L$ flows in the positive direction, the amplitude of voltage $C_{SE}$ (e.g., $|C_{SE}|$) increases, which is compared with the amplitude of signal $O_{EA1}$ (e.g., $|O_{EA1}|$) to generate signal $O_{CMP1}$ based on which current controller $I_{CTRL}$ generates signals $C_{ML}$ and $C_{MH}$. When $I_L$ decreases, however, circuit ZCD, based on the zero current condition reflected on voltage $C_{SE}$, provides output $O_{ZCD}$ based on which current controller $I_{CTRL}$ generates signals $C_{ML}$ and $C_{MH}$. For example, when $|I_L|$ decreases to zero, $|C_{SE}|$ decreases to 0, circuit ZCD detects a zero current condition of current $I_L$ and generates appropriate signal $O_{ZCD}$ based on which current controller $I_{CTRL}$ generates a high signal $C_{ML}$ to turn on NMOS $M_L$. In some embodiments, current controller $I_{CTRL}$ generates a high signal $C_{ML}$ and $C_{MH}$ to turn on NMOS $M_L$ and $M_H$ respectively. When current $I_L$ switches from the positive to the negative direction, the last zero current signal $O_{ZCD}$ in the positive current $I_L$ is skipped by the trigger signal $S_{SCAN}$ to keep the status of NMOS $M_H$ and $M_L$. That is, when current $I_L$ decreases during the boundary between the positive and negative domain, the NMOS $M_H$ and $M_L$ are respectively on and off even though current $I_L$ decreases to zero. When current $I_L$ decreases in the negative domain (e.g., current $I_L$ is negative), the amplitude of voltage $C_{SE}$ (e.g., $|C_{SE}|$) increases and is compared with the amplitude of signal $O_{EA1}$ (e.g., $|O_{EA1}|$) to generate signal $O_{CMP1}$ based on which current controller $I_{CTRL}$ generates signals $C_{ML}$ and $C_{MH}$ that are the inverse signals of those signals when current $I_L$ is positive. For example, when $|C_{SE}|$ is larger than $|O_{EA1}|$, NMOS $M_H$ and $M_L$ respectively turn off and on when current $I_L$ is negative. When the $|I_L|$ decreases to zero, circuit ZCD detects a zero current condition of current $I_L$ and generates appropriate signal $O_{ZCD}$ based on which current controller $I_{CTRL}$ generates a high signal $C_{ML}$ to turn off NMOS $M_L$. When current $I_L$ switches from negative to positive, the last zero current signal $O_{ZCD}$ when current $I_L$ is negative is skipped by the positive signal $O_{EA1}$ to keep the status of NMOS $M_H$ and $M_L$.

Signal $S_{SCAN}$ acting as a trigger signal synchronizes control signals $C_{ML}$ and $C_{MH}$ through current controller $I_{CRTL}$. Signal $S_{SCAN}$ through the current directional controller $I_{CTRL}$ and driver Drv generates signals $C_{ML}$ and $C_{MH}$ to control NMOS $M_L$ and $M_H$ respectively. Signal $S_{SCAN}$ includes signals $B_{SCAN}$, $R_{SCAN}$, and $G_{SCAN}$ (shown in FIG. 2) corresponding to the respective B, R and G LEDs. In some embodiments, signal $S_{SCAN}$, via signal $R_{SCAN}$ transitioning from a low to a high, triggers the energy recycling mode. Further, signals $B_{SCAN}$, $R_{SCAN}$, and $G_{SCAN}$ when transitioning from a low to a high indicate the respective LED transitioning from the Data phase to the Wait phase, and when transitioning from a high to a low indicate the end of the Display phase for the corresponding LED.

Driver Drv controls (e.g., turn on/off) powered NMOS $M_L$ and $M_H$. Driver Drv acts as a buffer for current controller $I_{CTRL}$ and sends control signals $C_{ML}$ and $C_{MH}$ to control powered NMOS $M_L$ and $M_H$, respectively. In some embodiments, signals $C_{ML}$ and $C_{MH}$ are reverse logics so that when NMOS $M_L$ is on, NMOS $M_H$ is off and vice versa. When signal $C_{ML}$ is high, signal $C_{MH}$ is low turning NMOS $M_L$ and $M_H$ on and off, respectively. When signal $C_{ML}$ is low, signal $C_{MH}$ is high turning NMOS $M_L$ and $M_H$ off and on, respectively.

Capacitor $C_O$ is used to filter the ripples, if any, existed on voltage $V_O$, and provides a stable voltage $V_O$.

Voltage $V_O$ commonly called a driving voltage (e.g., driving the LEDs) provides the voltage/current to light the RGB LEDs. The voltage level of voltage $V_O$ depends on the number of LEDs driven by voltage $V_O$. The higher the number of LEDs, the higher the voltage level for voltage $V_O$. In some embodiments, the high voltage of $V_O$ is 40V for 12 LEDs, but this voltage is about 30V for 8 LEDs, for example. In some embodiments, voltage $V_O$ dynamically switches for a corresponding R, G, or B LED. Further, when $V_O$ switches from a high voltage level towards a low voltage level (e.g., when the R LED transitions from the Data phase to the Wait phase), the charge due to the voltage drop is stored in capacitor (e.g., energy tank) $C_R$. When an LED demands energy (e.g., the G LED transitions from the Data phase to the Wait phase), the saved charge (e.g., energy) is used to generate the 40V high voltage level to drive the G LED. Because the saved energy is reused, energy is saved for circuit 100 as a whole.

In some embodiments, if $\Delta V_O$ is the change in voltage $V_O$, and $\Delta V_{CR}$ is the change in voltage $V_{CR}$, then $$\Delta V_O * C_O = \Delta V_{CR} * C_R \text{ or}$$

$$\Delta V_{CR} = \Delta V_O * C_O / C_R$$

Further, so that the driving voltage (e.g., output voltage) $V_O$ is greater than the supply voltage (e.g., or $V_{CR}$), $$V_O - \Delta V_O > V_{CR} + \Delta V_{CR} \text{ or}$$

$$V_O > V_{CR} + \Delta V_{CR} + \Delta V_O \text{ or}$$

$$V_O > V_{CR} + \Delta V_O * (C_O / C_R) + \Delta V_O \text{ or}$$

$$V_O > V_{CR} + \Delta V_O (1 + C_O / C_R)$$

The plurality of G, B, and R LEDs in some embodiments is used as backlights for a LED-backlit LCD display device or are used to directly display images in an LED display device, such as an LED television screen. Further, there are 12 LEDs for each G, B, and R color, but the embodiments are not limited to any particular number of LEDs. Each B, R, or G LED includes a data receiving phase (e.g., "Data"), a waiting phase (e.g., "Wait") and a display phase (e.g., "Display"). In the Data phase the LED, either B, R, or G, is "addressed," i.e., the system/circuit (e.g., a television) using the LEDs locates the appropriate LED. In the Wait phase, the television waits for the LCD image rotation to the appropriate position, and in the Display phase, the LED is turned on. Additionally, the forward (e.g., turn on) bias voltage for the G, B, and R LEDs are 3.3V, 3.3V, and 2.2V, respectively. In some embodiments, the B, R, and G LEDs are controlled to pass through the Data, the Wait, and the Display phases by the television using the LEDs.

PWM current controller receives dimming control signal DIMCTRL to control the duty cycle and the current of each B R or G LED. An LED using a higher current is brighter than an LED having a lower current. An LED is turned on/off depending on the duty cycle or the logic level of the corresponding pulse width in PWM current controller. For example, if the pulse width is high, the LED turns on, but if the pulse width is low, the LED turns off.

Resistors $R_1$ and $R_2$ serve as a voltage divider for voltage $V_O$ to generate voltage $V_{FB}$. When voltage $V_O$ changes, voltage $V_{FB}$ changes. Voltage $V_{FB}$ is used to compare with a corresponding reference voltage $V_R$, $V_B$, or $V_G$ reflecting through voltage $V_{REF}$.

Error amplifier EA1 compares voltage $V_{FB}$ to one of reference voltages $V_R$, $V_B$, or $V_G$ chosen as voltage $V_{REF}$, and provides signal $O_{EA1}$. Switches $S_R$, $S_B$, or $S_G$ are used to select the corresponding voltages $V_R$, $V_B$, or $V_G$ as the reference voltage $V_{REF}$ for amplifier EA1. For example, when switch $S_R$ is closed the corresponding voltage $V_R$ is selected as reference voltage $V_{REF}$. When switch $S_B$ is closed the corresponding voltage $V_B$ is selected as reference voltage $V_{REF}$, and when a switch $S_G$ is closed the corresponding voltage $V_G$ is selected as reference voltage $V_{REF}$, etc. In some embodiments, when the LED lighting sequence is B, R, and G, voltage $V_{REF}$ following voltages $V_B$, $V_R$, and $V_G$ has a wave form of High (H) Low (L) High (H) where the H, L, H correspond to $V_B$, $V_R$, and $V_G$, which is 3.3V, 2.2V, and 3.3V respectively. Signal $S_{SCAN}$ that includes signals $B_{SCAN}$, $R_{SCAN}$, $G_{SCAN}$ (shown in FIG. 2) corresponding to the B, R, G LEDs, controls the respective switches $S_B$, $S_R$, and $S_G$. For example, when signal $B_{SCAN}$ is high, switch $S_B$ closes and signal $V_B$ is used as a reference voltage $V_{REF}$ for error amplifier EA1. When signal $R_{SCAN}$ is high, switch $S_R$ closes and signal $V_R$ is used as a reference input for amplifier EA1. When signal $G_{SCAN}$ is high, switch $S_G$ closes and signal $V_G$ is used as a reference input for amplifier EA1, etc. Amplifier EA1 generates signal $O_{EA1}$ based on the difference between signals $V_{FB}$ and $V_{REF}$. In some embodiments, when $V_{FB}$ is lower than $V_{REF}$, signal $O_{EA1}$ is high, and when $V_{FB}$ is higher than $V_{REF}$, signal $O_{EA1}$ is low or negative.

Comparator CMP1 compares signal $O_{EA1}$ with voltage $C_{SE}$ and provides signal $O_{CMP1}$ to control the direction of current $I_L$. In some embodiments, comparator CMP1 generates signal $O_{CMP1}$ to stop $|I_L|$ from increasing when $|I_L|$ reaches a level that $|C_{SE}|$ is higher than $|O_{EA1}|$. In some embodiments, whenever $|C_{SE}|$ is higher than $|O_{EA1}|$, $O_{CMP1}$ is high and current controller $C_{CTRL}$ generates a low signal $C_{ML}$ and a high signal $C_{MH}$ to turn off $M_L$ and turn on $M_H$. Turning off $M_L$ and turning on $M_H$ changes the flow of current $I_L$ (e.g., from increasing to decreasing).

Illustrative Waveforms

Figure 2:
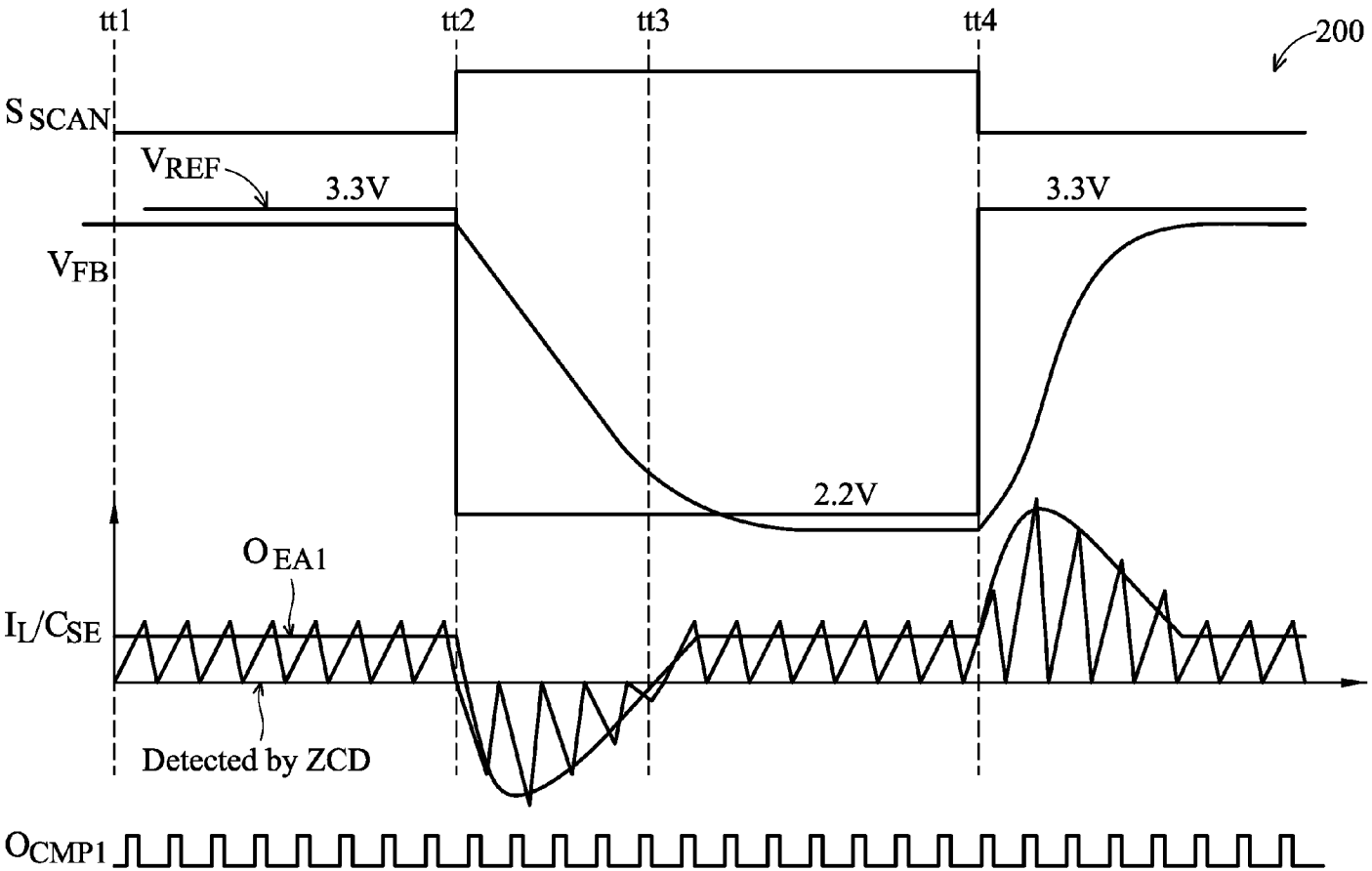
FIG. 2 is a graph of waveforms related to some signals in the circuit of FIG. 1, in accordance with some embodiments.

FIG. 2 is a graph of waveforms 200 illustrating the relationship between various signals for circuit 100, in accordance with some embodiments. In this illustration, circuit 100 is in the energy recycle mode in the period between time tt2 and tt3.

In FIG. 2, whenever $|C_{SE}|$ is greater than $|O_{EA1}|$, signal $O_{CMP1}$ is high, and signal $C_{SE}$ corresponding current $I_L$ changes the flow from increasing to decreasing or from decreasing to increasing. Similarly, whenever $|C_{SE}|$ reaches 0 indicating the zero current condition for current $I_L$, $|C_{SE}|$ and $|I_L|$ also changes the flow from increasing to decreasing or from decreasing to increasing.

In effect, signals $O_{CMP1}$ and $O_{ZCD}$ set the respective maximum and minimum values for $|C_{SE}|$. Considering the real value including the sign (e.g., positive/negative), when current $I_L$ is in the positive domain (e.g., prior to time tt2 and after time tt3), signals $O_{CMP1}$ and $O_{ZCD}$ set the respective maximum and minimum amplitude for signal $C_{SE}$. But when current $I_L$ is in the negative domain (e.g., time period between time tt2 and tt3, signals $O_{CMP1}$ and $O_{ZCD}$ set the respective minimum and maximum amplitude for signal $C_{SE}$.

In some embodiments where current $I_L$ is in the negative domain and signal $O_{EA1}$ is not generated as a negative voltage for comparator CMP1, a timer is used to generate signal $O_{CMP1}$ having a fixed time pulse.

The Boost Mode

Figure 3:
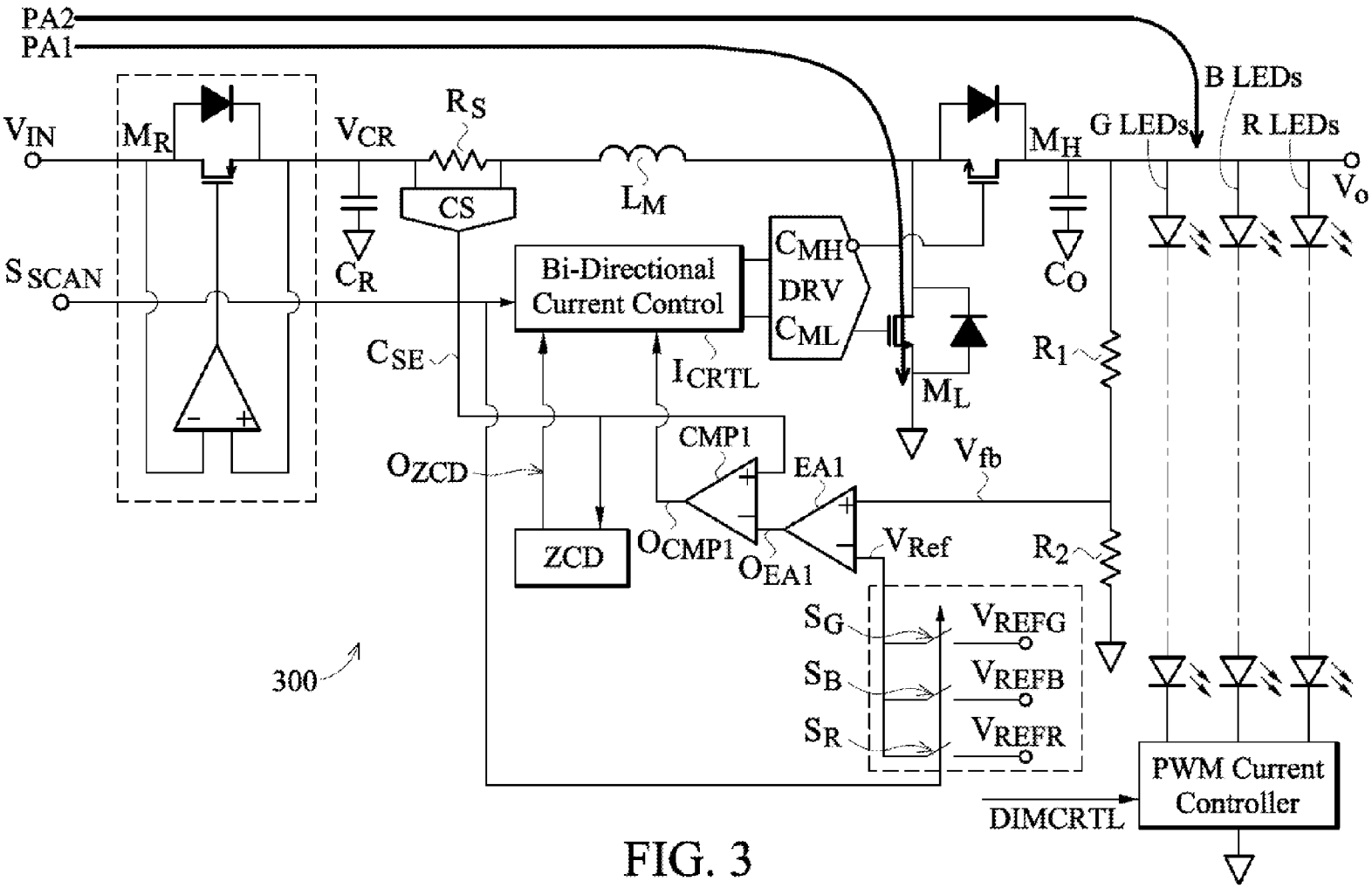
FIG. 3 is a schematic diagram of the circuit in FIG. 1 in a boost mode, in accordance with some embodiments.

FIG. 3 is a schematic diagram 300 illustrating the operation of circuit 100 in the boost mode, in accordance with some embodiments.

In the boost mode, voltage $V_{IN}$ is used as the voltage source to generate voltage $V_O$. In some embodiments, voltage $V_{CR}$ is initially 0V while voltage $V_{IN}$ is 12V. Because voltage $V_{IN}$ is greater than voltage $V_{CR}$, diode $M_R$ turns on, current $I_L$ flows in the positive domain, e.g., in direction $D_{IO}$, but through two different paths, path PA1 and path PA2. Further, current $I_L$ flows through path PA1 first because the power converter comprising inductor $L_M$ and two NMOS $M_L$ and $M_H$ first stores the energy in inductor $L_M$ that causes current $I_L$ to increase. The power converter then converts the stored energy to output $V_O$ and switches back and forth between paths PA1 and PA2. In path PA1 NMOS $M_H$ is off while NMOS $M_L$ is on, and current flows through $M_L$. Current $I_L$ increases from 0V to its peak level determined by signal $O_{EA1}$. That is, current $I_L$ increases until voltage $C_{SE}$ is greater than voltage $O_{EA1}$. At that time, comparator CMP1 generates a high signal $O_{CMP1}$, and current direction controller $I_{CTRL}$, based on the high $O_{CMP1}$, generates a low signal $C_{ML}$ to turn off $M_L$ and turn on $M_H$. When $M_H$ turns on current $I_L$ flows through path PA2 and turns on the corresponding LED. Because the LED lights and consumes energy, current $I_L$ starts to decrease, and causes voltage $C_{SE}$ to decrease until circuit ZCD, based on voltage $C_{SE}$, detects the zero current condition and provides the corresponding signal $O_{ZCD}$ (e.g., high). Current direction controller $I_{CTRL}$, based on signal $O_{ZCD}$, generates a high signal $C_{ML}$ to turn on $M_L$ for current $I_L$ to flow through path PA1. Current switching between paths PA1 and PA2 continues until circuit 100 is out of the boost mode.

Figure 4:
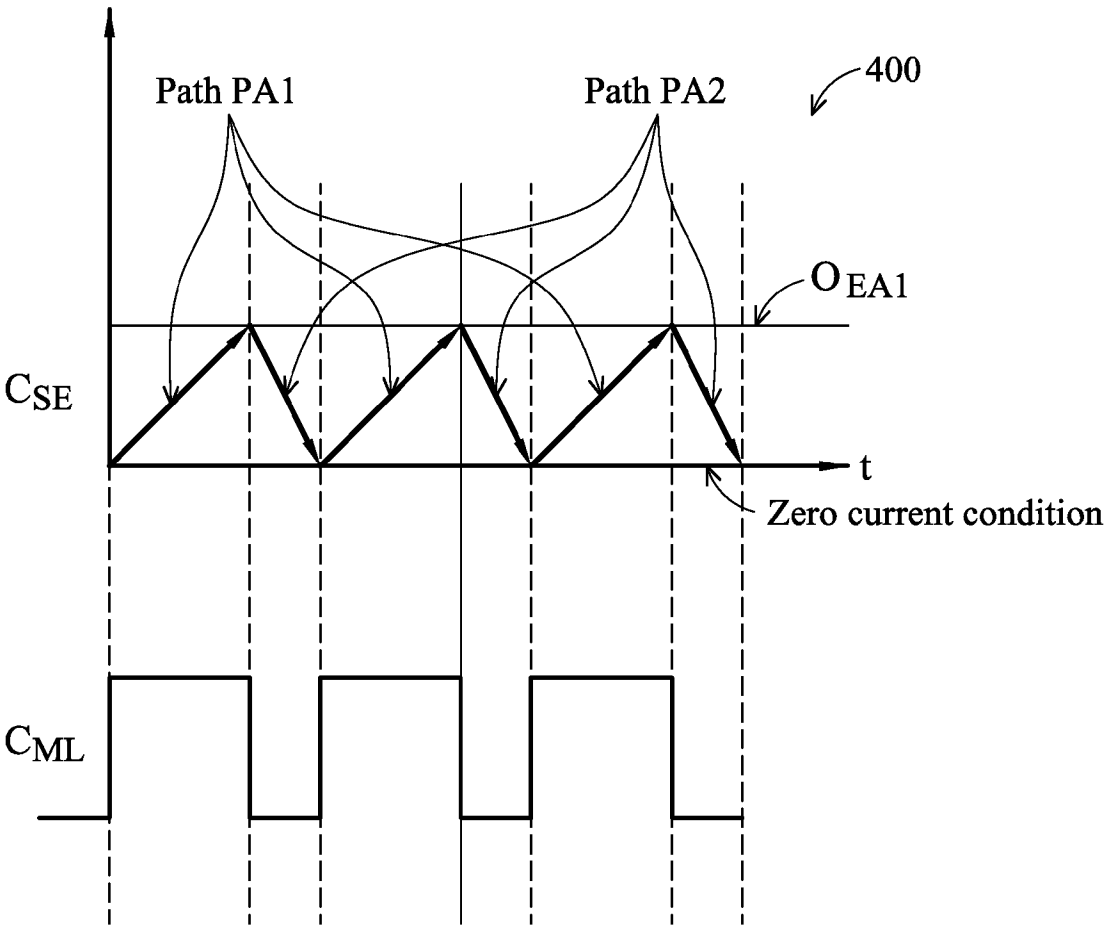
FIG. 4 is a graph of waveforms illustrating the relationship of some signals of the circuit in FIG. 3, in accordance with some embodiments.

FIG. 4 is a graph of waveforms 400 illustrating the relationship of various currents and voltages corresponding to the operation of circuit 100 in FIG. 3, in accordance with some embodiments. During the time signal $C_{ML}$ is high NMOS $M_L$ is on, current $I_L$ flows through path PA1 and its magnitude increases until voltage $C_{SE}$ reaches (e.g., a little higher) than signal $O_{EA1}$. In contrast, during the time signal $C_{ML}$ is low, NMOS $M_L$ is off, NMOS $M_H$ is on. Current $I_L$ flows through path PA2, and decreases until the zero current condition occurs.

The Energy Recycling Mode

Figure 5:
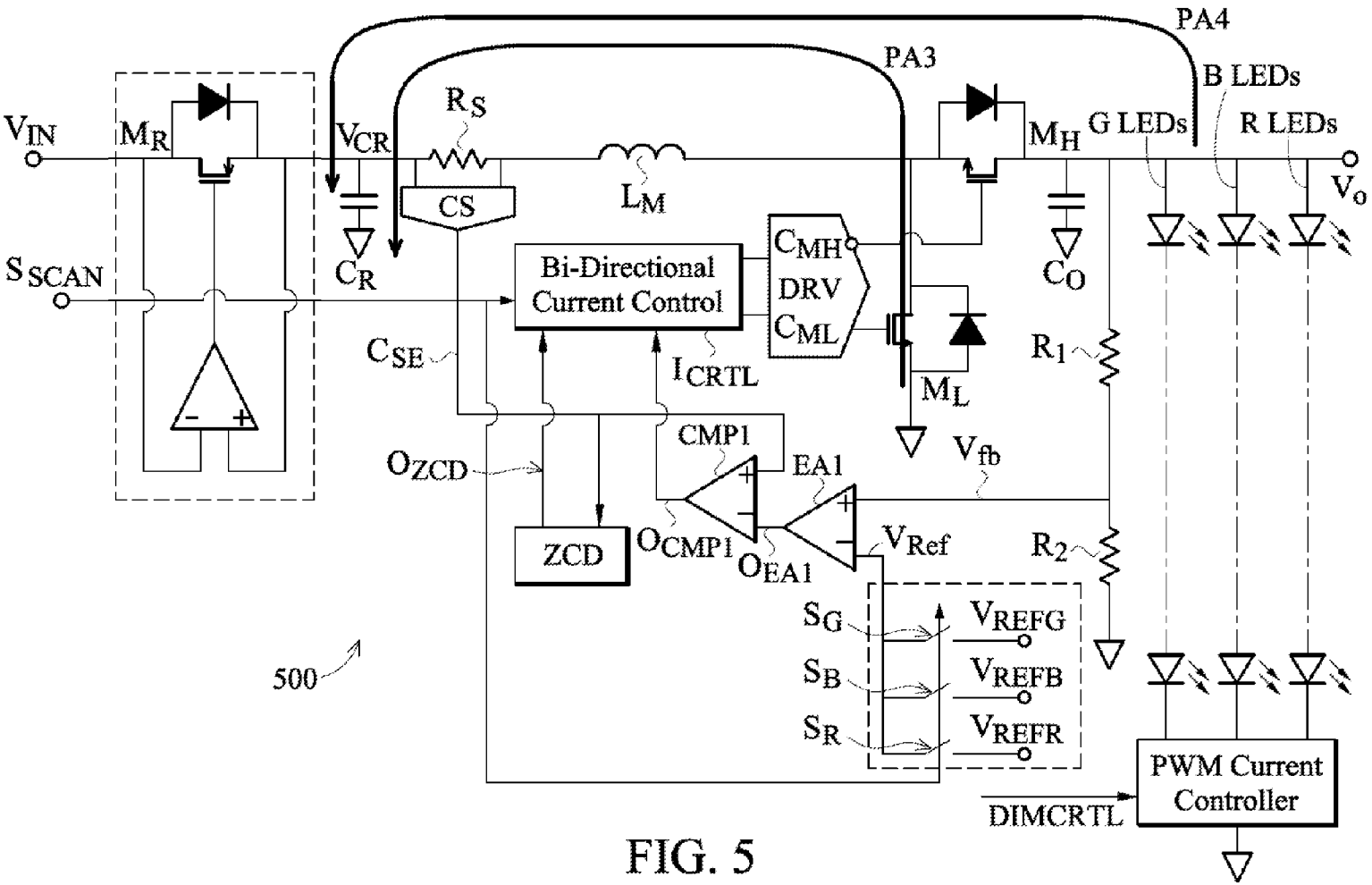
FIG. 5 is a schematic diagram of the circuit in FIG. 1 in an energy recycle mode, in accordance with some embodiments.

FIG. 5 is a schematic diagram 500 illustrating circuit 100 in the energy recycling mode, which follows a boost mode as illustrated in FIG. 3. When voltage $V_O$ starts dropping from a high voltage level (e.g., 40V) toward a low (e.g., 26V) (e.g., when the R LED transition from the Data phase to the Wait phase), some embodiments save the energy (e.g., the charge) resulting from this voltage drop. In this illustration, the power converter comprising inductor $L_M$ and two NMOS $M_L$ and $M_H$ switches to the "buck" mode operation in which voltage $V_{CR}$ is "stepped down" from about 40V of the output $V_O$ to about 19V. Current $I_L$ flows in direction $D_{OI}$, which is trigged by the signal $S_{SCAN}$ and ended by signal $O_{EA1}$. Current $I_L$ flows through two different paths, e.g., path PA3 and path PA4. Because current $I_L$ flows in direction $D_{OI}$, it's a negative current. Current $I_L$ flowing through inductor $L_M$ generates the energy stored by capacitor $C_R$. Stated another way, current $I_L$ harvests the charge resulting from the voltage drop to the energy tank $C_R$. As $|I_L|$ increases, voltage $V_{CR}$ increases until it's higher than voltage $V_{IN}$, diode $M_R$ turns off. Because, in some embodiments $V_R$ is about 0.2 V less than voltage $V_{IN}$, it does not take too long from the time current $I_L$ flows in the $D_{OI}$ direction for diode $M_R$ to turn off.

In some embodiments, current $I_L$ flows through path PA4 first because the boundary between the positive and negative domain is current path PA2 in the boost mode and current path PA4 in this energy recycling mode. Current $I_L$ also switches back and forth between paths PA4 and PA3. In path PA4 NMOS $M_H$ is on while NMOS $M_L$ is off, and current flows through $M_H$. The $|I_L|$ increases (or current $I_L$ decreases) from 0V to its peak level determined by signal $O_{EA1}$. That is, $|I_L|$ increases until $|C_{SE}|$ is greater than $|O_{EA1}|$. At that time, current direction controller $I_{CTRL}$ generates a high signal $C_{ML}$ to turn on $M_L$ and turn off $M_H$. When $M_L$ turns on current $I_L$ flows through path PA3. $|I_L|$ starts to decrease causing $|C_{SE}|$ to decrease until circuit ZCD detects the zero current condition through voltage $C_{SE}$ from which current direction controller $I_{CTRL}$ generates a low signal $C_{ML}$ to turn off $M_L$ for current $I_L$ to flow through path PA3. Current switching between paths PA3 and PA4 continues until circuit 100 is out of the energy recycle mode.

Figure 6:
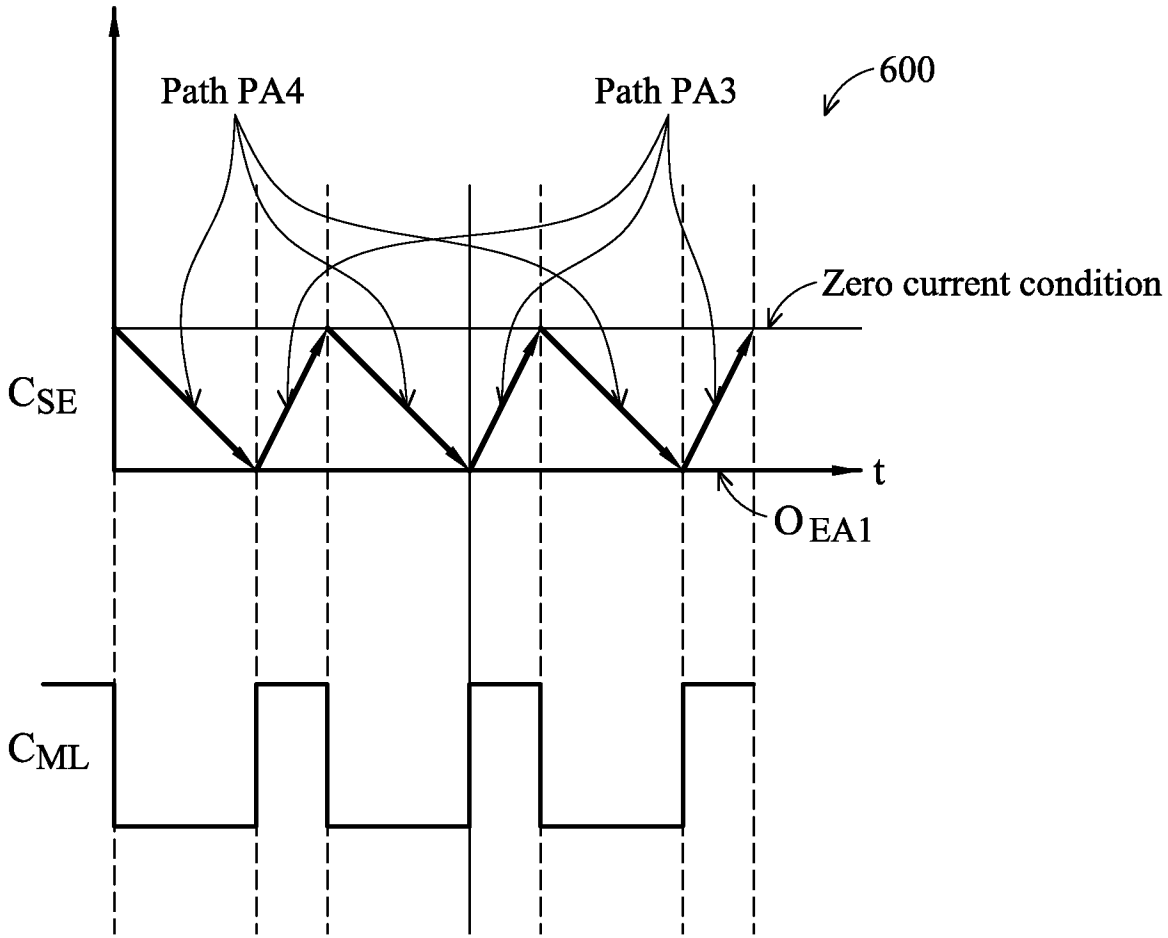
FIG. 6 is a graph of waveforms illustrating the relationship of some signals of the circuit in FIG. 5, in accordance with some embodiments.

FIG. 6 is a graph of waveforms 600 illustrating the relationship of various currents and voltages corresponding to the operation of circuit 100 in FIG. 5, in accordance with some embodiments. During the time signal $C_{ML}$ is low NMOS $M_L$ is off, current $I_L$ flows through path PA4 and $|I_L|$ increases until $|C_{SE}|$ reaches (e.g., a little higher than) $|O_{EA1}|$. In contrast, during the time signal $C_{ML}$ is high, NMOS $M_L$ is on, NMOS $M_H$ is off. Current $I_L$ flows through path PA3, and $|I_L|$ decreases until the zero current condition occurs.

In some embodiments, current direction controller $I_{CTRL}$ includes a time constant $T_{CONST}$ to limit the time current $I_L$ flows through path PA4. Even if the zero current condition has not occurred but if the time from which $|I_L|$ starts increasing has passed the time constant $T_{CONST}$, current direction controller $I_{CTRL}$ also generates signal $C_{ML}$ (e.g., a low) to turn off NMOS $M_L$.

The Silence Mode

Figure 7:
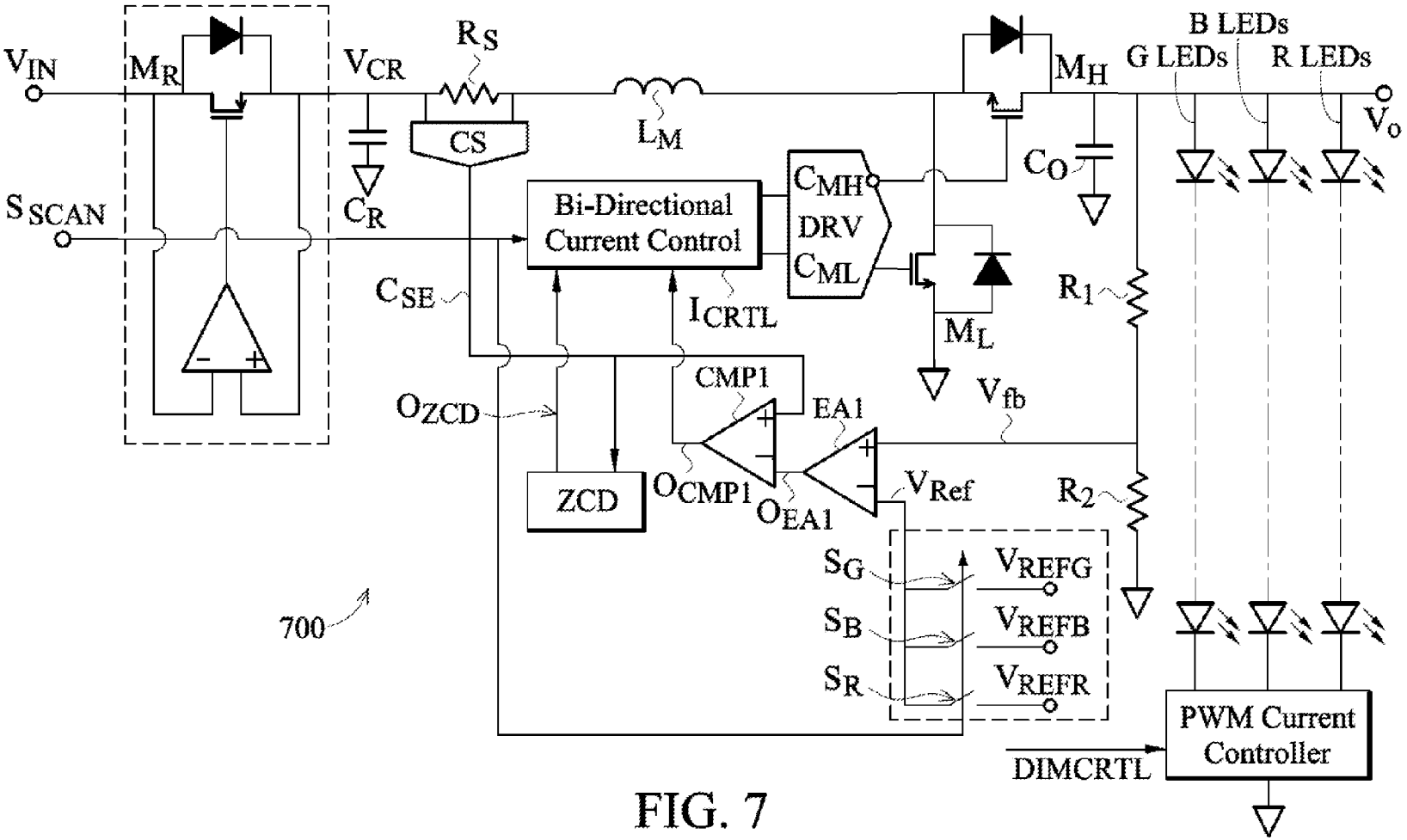
FIG. 7 is a schematic diagram of the circuit in FIG. 1 in a silence mode, in accordance with some embodiments.

FIG. 7 is a schematic diagram 700 illustrating circuit 100 in the silence mode that follows an energy recycle mode as illustrated in FIG. 5, in accordance with some embodiments. When voltage node $V_O$ does not demand energy (e.g., voltage/current) for the LEDs (e.g., the R LED is in the Wait phase), current $I_L$ is zero, circuit 100 switches to the silence mode. In this illustration, because circuit 100 has just come out of the energy recycling mode, voltage $V_{CR}$ is greater than voltage $V_{IN}$, diode $M_R$ turns off. Additionally, because there is not any current $I_L$, both $M_H$ and $M_L$ turn off. During the silence mode the energy (the charge) is hold in the energy tank $C_R$.

The Energy Transfer Mode

Figure 8:
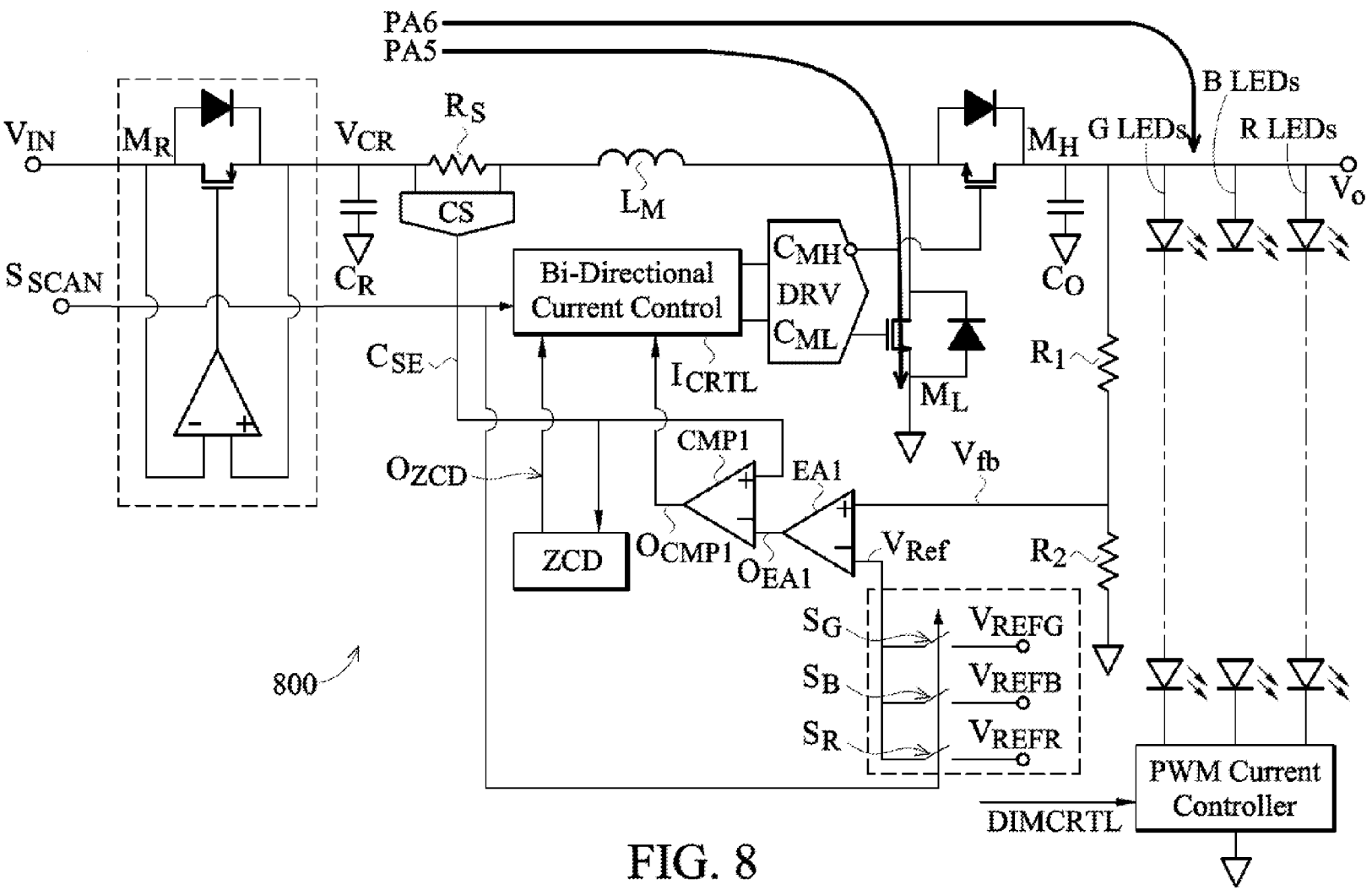
FIG. 8 is a schematic diagram of the circuit in FIG. 1 in an energy transfer mode, in accordance with some embodiments.

FIG. 8 is a schematic diagram 800 illustrating the operation of circuit 100 in the energy transfer mode that follows the silence mode as illustrated in FIG. 7, in accordance with some embodiments. In the energy transfer mode, voltage $V_{CR}$ from the energy tank $C_R$, instead of voltage $V_{IN}$, is used as an input to generate voltage $V_O$. In FIG. 8, because circuit 100 has just come out of the silence mode, voltage $V_{CR}$ remains greater than voltage $V_{IN}$, diode $M_R$ turns off. Current $I_L$ flows in direction $D_{IO}$ through an LED (e.g., the R LED) that lights the LED. Because voltage $V_{CR}$ is used as an input, the saved charge in capacitor $C_R$ during the energy-recycle mode is transferred to node $V_O$ to drive the corresponding LED (e.g., R LED). The operation in this mode is the same as in the boost mode except voltage $V_{CR}$ instead of voltage $V_{IN}$ is used as an input. As a result, the current paths PA5 and PA6 correspond to the respective current paths PA1 and PA2. Once the saving energy is fully transferred, i.e., the charge stored in capacitor $C_R$ has exhausted, voltage $V_{CR}$ drops until $V_{IN}$ is greater than $V_{CR}$. At that time, active diode $M_R$ turns on and circuit 100 returns to the boost mode, i.e., voltage $V_{IN}$ functions in place of voltage $V_{CR}$.

Illustrative Waveforms

Figure 9:
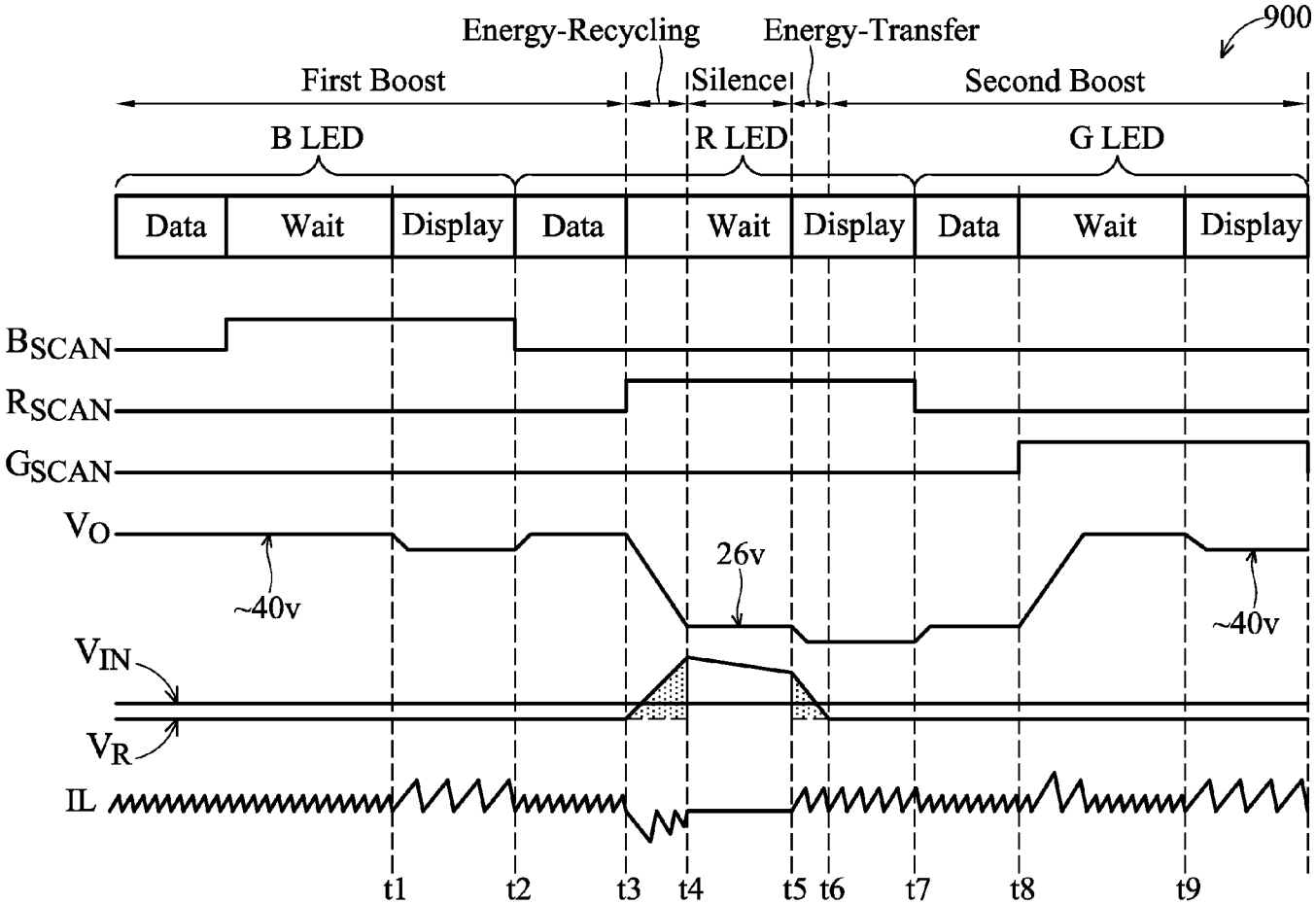
FIG. 9 is a graph of waveforms illustrating an operation of the circuit in FIG. 1, in accordance with some embodiments.

FIG. 9 is a graph of waveforms 900 illustrating an operation of circuit 100 in accordance with some embodiments. In this illustration, circuit 100 transitions through an operation cycle including a first boost mode, an energy-recycling mode, a silence mode, an energy transfer mode, and a second boost mode. The operation cycle corresponds to the sequential operation of three B, R, and G LEDs, each of which transitions through the Data, the Wait, and the Display phases.

When signals $B_{SCAN}$, $R_{SCAN}$, and $G_{SCAN}$ rise from a low to a high the respective B, R, and G LEDs transition from the Data phase to the Wait phase. That is, the LEDs have been addressed and the LCDS for the LEDs enter the LCD rotation mode. The system (e.g., the television) using the LEDs waits for the LEDs to be ready for lighting. When signals $B_{SCAN}$, $R_{SCAN}$, and $G_{SCAN}$ fall from a high to a low, the corresponding LEDs have been displayed for the particular operation cycle. At the beginning of the first boost mode (e.g., prior to time t1) and at the end of the second boost mode (e.g., a little after time t6), voltage $V_O$ is at the high logic level (e.g., about 40V).

At time t1, the B LED is in the Display mode. Voltage $V_O$ drops a little because of the current demand for displaying, but still stays around the 40V range. The B LED turns on. Current $I_L$ switches in the positive domain, having the peak controlled by voltage $V_O$, $V_{FB}$, and $O_{EA1}$. Current $I_L$ is in the cycle of increasing, decreasing, increasing, etc., reflecting the current paths PA1 and PA2 in FIG. 3. The amplitude of current $I_L$ during the Display phase (e.g., between time t1 and time t2), however, is higher than that of the other phases (e.g., B Data, B Wait, and R Data phases) because displaying demands higher current.

At time t2, after the B LED has been displayed, the R LED is in the Data phase (e.g., the television addresses the R LED). $|I_L|$ drops to about 0V like in the time period prior to time t1 because the high current demand for displaying the B LED has ended.

At time t3, in some embodiments, when the R LED transitions from the Data to the Wait phase, signal $R_{SCAN}$ (e.g., the scan signal for the R LED) reaches a high voltage $V_O$ starts dropping from 40V towards 26V, circuit 100 enters the energy recycling mode. As a result, current $I_L$ switches in the negative domain in direction $D_{OI}$. The amplitude of current $I_L$ in the repeated cycles of increasing then decreasing reflects the current paths PA3 and PA4 in FIG. 4. Voltage $V_{CR}$ increases because $|I_L|$ increases and the negative current $I_L$ is the charging current that causes voltage $V_{CR}$ to increase.

At time t4, after the energy-recycling mode ends, circuit 100 enters the silence mode where the energy is stored in the energy tank until time t5. In this mode, between times t4 and t5, voltage $V_O$ remains at the low of 26V, but circuit 100 does not experience any activity because the television is waiting for the R LED to be displayed. As a result, current $I_L$ remains at 0 A without switching. Voltage $V_{CR}$ slopes a little around the voltage acquired during the energy recycling mode because of some current leakage in circuit 100.

At time t5, the R LED is displayed, which demands energy (e.g., voltage/current at $V_O$). Circuit 100 enters the energy-transfer mode. That is, circuit 100 uses the energy stored in energy tank $C_R$ (e.g., voltage $V_{CR}$) to generate voltage $V_O$ to display the R LED. Current $I_L$ starts switching in the positive domain using the current paths P5 and P6 in FIG. 8. As the energy is consumed, voltage $V_{CR}$ starts decreasing until the saved energy in energy tank $C_R$ is exhausted. At that time, circuit 100 ends its energy transfer mode.

At time t6, because the saved energy has been exhausted, circuit 100 enters the boost mode (e.g., the second boost mode) to use voltage $V_{IN}$ to continue generating voltage $V_O$ and thus continues displaying the R LED. As a result, current $I_L$ still switches in the positive domain in direction $D_{IO}$.

At time t7 the R LED ends its Display phase and the G LED enters the Data phase, which does not demand much current. $|I_L|$, as a result, decreases.

At time t8, the G LED enters its Wait phase, demanding voltage $V_O$. Voltage $V_O$ starts to increase until it reaches 40V some time later in the Wait phase, and remains around 40V during the Wait and Display phases of the G LED. During the time voltage $V_O$ increases, $|I_L|$ increases, and decreases when voltage $V_O$ stables at 40V.

At time t9, the G LED enters its Display phase, circuit 100 having been in the second boost mode uses voltage $V_{IN}$ to generate voltage $V_O$. Because the G LED is in the Display phase, $|I_L|$ increases.

In the above illustration, current $I_L$ switches in the positive domain or flows in direction $D_{IO}$ in time periods prior to time t3 and subsequent to time t4, and flows in the direction $D_{OI}$ in the period between times t3 and t4, which is consistent with the fact that in the energy recycling phase current flows in an opposite direction with the current flow in other phases.

Exemplary Method

Figure 10:
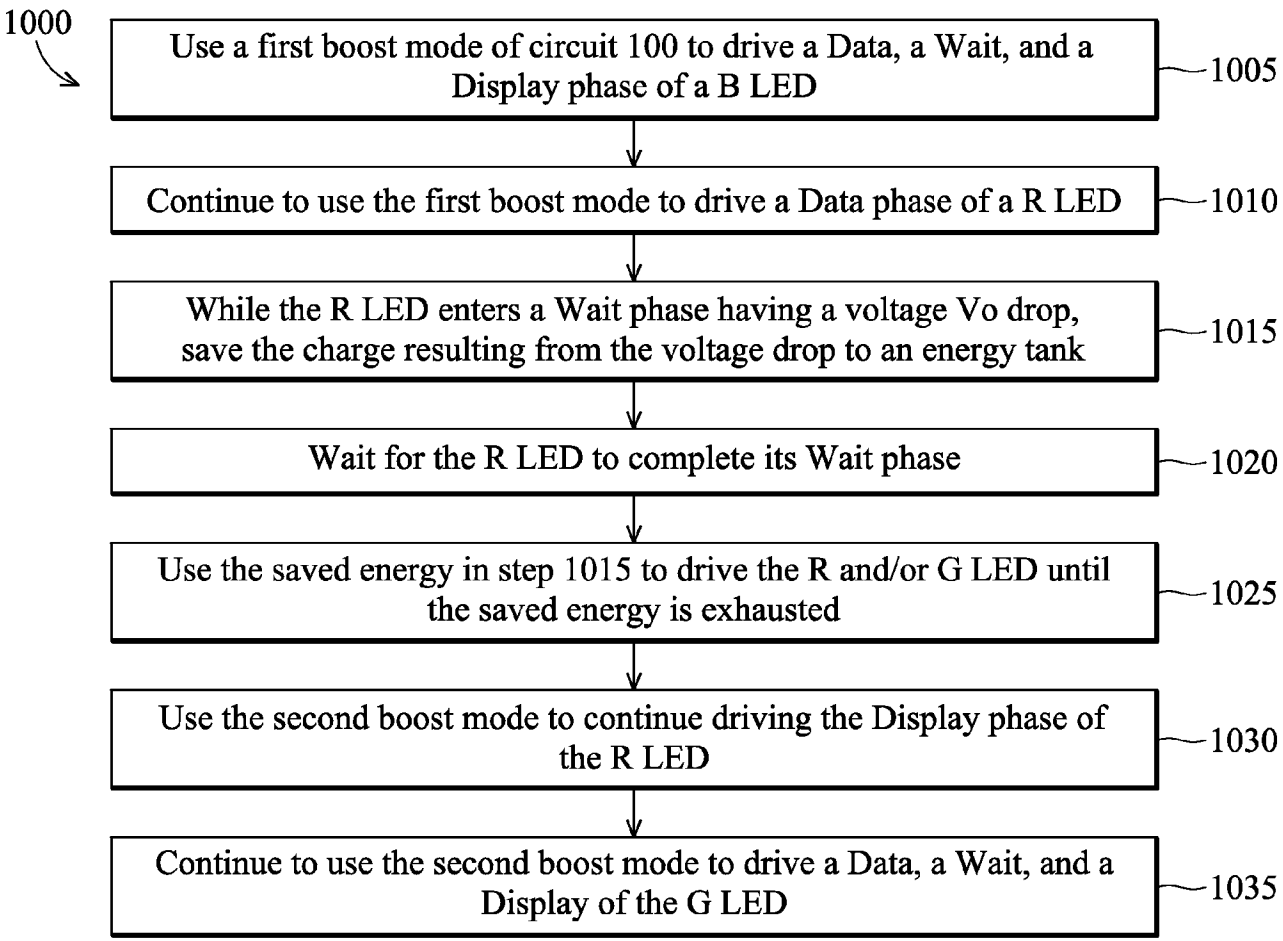
FIG. 10 is a flow chart illustrating a method related to the circuit in FIG. 1, in accordance with some embodiments.

FIG. 10 is a flow chart 1000 illustrating a method related to circuit 100, in accordance with some embodiments.

In step 1005, a first boost mode of circuit 100 is used to drive a Data, a Wait, and a Display phase of a B LED.

In step 1010, the first boost mode continues to drive a Data phase of a R LED.

In step 1015, while the R LED enters a Wait phase having a voltage $V_O$ drop, the charge resulting from the voltage drop to is saved to an energy tank.

In step 1020, the television waits for the R LED to complete its Wait phase.

In step 1025, the saved energy in step 1015 is used to continue driving the R and/or G LED until the saved energy is exhausted. For illustration, the saved energy is exhausted before the Display phase of the R LED.

In step 1030, the second boost mode is used to continue driving the Display phase of the R LED.

In step 1035, the second boost mode is used to continue driving a Data, a Wait, and a Display phase of the G LED.

Exemplary Advantage

Figure 11:
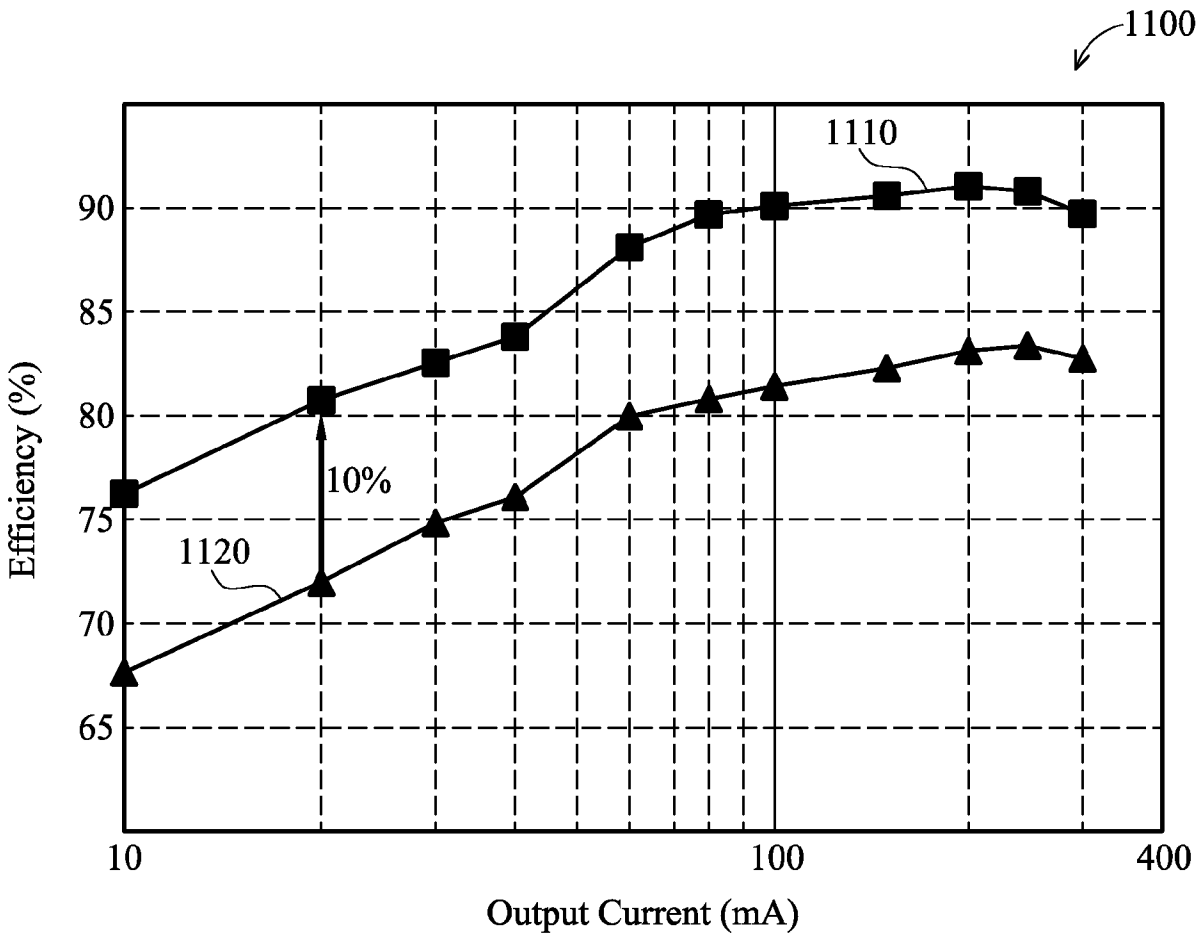
FIG. 11 is a graph of waveforms illustrating an advantage of the circuit in FIG. 1, in accordance with some embodiments.

FIG. 11 is a graph of waveforms 1100 illustrating an advantage of circuit 100, in accordance with some embodiments. The X-axis shows the output current (e.g., current $I_O$), which is the current at node $V_O$ flowing into the corresponding LEDs, in milli Amperes (mA) in a log scale. The Y-axis shows the efficiency in terms of the ratio between the output power $P_O$ and the input power $P_I$ wherein $P_O=V_O*I_O$ and $P_I=V_{IN}*$the input current. In an ideal situation, PO/PI=100%. Line 1110 represents the efficiency with respect to output current $I_O$ without the energy saving mechanism of circuit 100. Line 1120 represents the efficiency with respect to current $I_O$ with the energy saving mechanism of circuit 100. As shown in FIG. 11, circuit 100 (line 1120) is about 10% better than a circuit without using the energy saving mechanism.

A number of embodiments have been described. It will nevertheless be understood that various modifications may be made without departing from the spirit and scope of the invention. For example, the various transistors being shown as a particular dopant type (e.g., NMOS and PMOS) are for illustration purposes, embodiments of the disclosure are not limited to a particular type, but the dopant type selected for a particular transistor is a design choice and is within the scope of embodiments. The logic level (e.g., low or high) of the various signals used in the above description is also for illustration purposes, embodiments are not limited to a particular level when a signal is activated and/or deactivated, but, rather, selecting such a level is a matter of design choice.

The various figures show the resistors and capacitors (e.g., resistors R1, R2, capacitors $C_R$, $C_O$, etc.) using discrete resistors and capacitors for illustration only, equivalent circuitry may be used. For example, a resistive device, circuitry or network (e.g., a combination of resistors, resistive devices, circuitry, etc.) can be used in place of the resistor. Similarly, a capacitive device, circuitry or network (e.g., a combination of capacitors, capacitive devices, circuitry, etc.) can be used in place of the capacitor. Additionally, other devices, networks, etc., including rechargeable batteries, that store energy (e.g., charge) can be used in place capacitor or energy tank $C_R$.

Circuit 100 with exemplary voltage levels of 40V, 26V, etc., is used for illustration. Some embodiments include other circuits that use multiple voltage levels, including, for example, 30V, 20V, 15V, etc. Embodiments of this disclosure are not limited to any number of voltage levels or a particular value for a level. The energy recycling mode is illustrated when voltage $V_O$ decreases, but principles of the disclosed embodiments are applicable when the voltage increases. Further, the disclosed embodiments can be used in programmable DC power supplies (such as the Agient N6705A), sequential power applications, traffic LED lights, advertising lights, etc.

The above method embodiment shows exemplary steps, but they are not necessarily performed in the order shown. Steps may be added, replaced, changed order, and/or eliminated as appropriate, in accordance with the spirit and scope of disclosed embodiments.

Each claim of this document constitutes a separate embodiment, and embodiments that combine different claims and/or different embodiments are within scope of the disclosure and will be apparent to those of ordinary skill in the art after reviewing this disclosure.

What is claimed is:

1. A method comprising:

using an input voltage at an input node to generate, at an output node, an output voltage having a first voltage level;

in a first period, when the input node is electrically disconnected from the output node and the output voltage changes from the first voltage level to a second voltage level, storing electrical charges resulted from the output voltage changing from the first voltage level to the second voltage level; and in a second period subsequent to the first period when the input node is electrically disconnected from the output node and the output node demands energy, using a voltage generated from the stored electrical charges in place of the input voltage to generate the output voltage.

2. The method of claim 1 further comprising using a first mode of a plurality of modes of a circuit that receives the input voltage and provides the output voltage to drive a first phase, a second phase, and a third phase of a first LED, and a first phase of a second LED.

3. The method of claim 2 further comprising using a second mode of the plurality of modes of the circuit to drive a second phase of the second LED when the output voltage changes from the first level to the second level.

4. The method of claim 3 further comprising using a third mode of the plurality of modes of the circuit to continue driving the second phase of the second LED.

5. The method of claim 4 further comprising using a fourth mode of the plurality of modes of the circuit to drive one or a combination of a third phase of the second LED, a first phase of a third LED, a second phase of the third LED, or a third phase of the third LED.

6. The method of claim 4 further comprising using the first mode of the plurality of modes of the circuit to drive a third phase of the second LED.

7. A circuit comprising:

an input node configured to provide an input voltage;

an energy node coupled to an energy tank;

a device configured to electrically connect the energy node to or electrically disconnect the energy node from the input node;

an output node configured to provide an output voltage; and a power converter circuit coupled between the energy node and the output node;

wherein when the device electrically disconnects the input node from the energy node and the output voltage changes from a first voltage level to a second voltage level, the power converter circuit is configured for storing, in the energy tank, charges resulted from the output voltage changing from the first voltage level to the second voltage level; and when the device electrically disconnects the input node from the energy node and the output node demands energy, the power converter circuit is configured for using a voltage at the energy node to generate the output voltage at the output node.

8. The circuit of claim 7 further comprising a plurality of LEDs driven by the output voltage.

9. The circuit of claim 7 further comprising a feedback circuit coupled between the output node and the power converter circuit to change a direction of a current in the power converter circuit toward the output node or toward the energy node.

10. The circuit of claim 9 wherein the direction of the current is based on a zero condition of the current or on a voltage level proportional to the current against a reference voltage.

11. The circuit of claim 7 being configured to operate:

in a first mode when the device is configured to electrically connect the input node to the energy node;

in a second mode when the device is configured to electrically disconnect the input node from the energy node and when the output voltage changes from the first voltage level to the second voltage level;

in a third mode when the power converter circuit is off; and in a fourth mode when the power converter circuit is configured for using the voltage at the energy node to generate the output voltage.

12. The circuit of claim 11 being configured to operate in a sequence of the first mode, the second mode, the third mode, and the fourth mode to drive a sequence of a blue LED, a red LED, and a green LED.

13. The circuit of claim 7 wherein the power converter circuit comprises:

an inductor coupled to a first switch and a second switch, the first switch is configured for an amplitude of a current flowing to the inductor to increase and the second switch is configured for the amplitude of the current to decrease.

14. The circuit of claim 7 wherein the first voltage level is higher than the second voltage level.

15. A circuit comprising:

an input node configured to provide an input voltage;

a device coupled to the input node;

an energy node coupled to the device and to an energy tank; the device configured to electrically connect the energy node to or electrically disconnect the energy node from the input node;

a sensing circuit coupled to the energy node;

a power converter circuit coupled to the sensing circuit;

an output node coupled to the power converter circuit and configured to provide an output voltage;

a feedback circuit coupled between the output node and the sensing circuit wherein when the device electrically disconnects the input node from the energy node and the output voltage changes from a first voltage level to a second voltage level, the power converter circuit is configured for storing, in the energy tank, charges resulted from the output voltage changing from the first voltage level to the second voltage level;

when the device electrically disconnects the input node from the energy node and the output node demands energy, the power converter circuit is configured for using a voltage at the energy node to generate the output voltage at the output node; and the feedback circuit, based on an output of the sensing circuit, is configured for causing the power converter circuit to increase or to decrease an amplitude of a current in the power converter circuit.

16. The circuit of claim 15 wherein the power converter comprises an inductor coupled to a first powered NMOS and a second powered NMOS, when the first powered NMOS is configured to be on, the second powered NMOS is configured to be off, and when the first powered NMOS is configured to be off, the second powered NMOS is configured to be on.

17. The circuit of claim 15 further comprising a plurality of LEDs driven by the output voltage.

18. The circuit of claim 15 being configured to operate:

in a first mode when the device is configured to electrically connect the input node to the energy node;

in a second mode when the device is configured to electrically disconnect the input node from the energy node and when the output voltage changes from the first voltage level to the second voltage level;

in a third mode when the power converter circuit is off; and in a fourth mode when the power converter circuit is configured for using the voltage at the energy node to generate the output voltage.

19. The circuit of claim 15 wherein the first voltage level is higher than the second voltage level.

20. The circuit of claim 15 wherein the sensing circuit detects a zero condition of the current or a voltage level proportional to the current against a reference voltage; and the feedback circuit, based on the detected zero condition of the current or the detected voltage level proportional to the current against the reference voltage, is configured for causing the power converter circuit to increase or to decrease the amplitude of the current, respectively.

* * * * *